US009098071B2

(12) United States Patent
Honda

(10) Patent No.: US 9,098,071 B2
(45) Date of Patent: Aug. 4, 2015

(54) ELECTRONIC TIMEPIECE AND CONTROL METHOD THEREFOR

(75) Inventor: Katsuyuki Honda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 322 days.

(21) Appl. No.: 13/418,684

(22) Filed: Mar. 13, 2012

(65) Prior Publication Data

US 2012/0243383 A1 Sep. 27, 2012

(30) Foreign Application Priority Data

Mar. 25, 2011 (JP) ..... 2011-068872

(51) Int. Cl.
*G04C 11/02* (2006.01)
*G04C 10/02* (2006.01)
*G04R 20/04* (2013.01)

(52) U.S. Cl.
CPC ..... *G04C 10/02* (2013.01); *G04R 20/04* (2013.01)
USPC ..... 368/47

(58) Field of Classification Search
CPC ..... G04R 20/02
USPC ..... 368/47
See application file for complete search history.

(56) References Cited

U.S. PATENT DOCUMENTS 7,079,451 B2 * 7/2006 Okeya ..... 368/47
7,983,116 B2 * 7/2011 Fujisawa ..... 368/47
8,009,519 B2 * 8/2011 Jazra et al. ..... 368/47
8,169,857 B2 * 5/2012 Matsuzaki ..... 368/47
2010/0054087 A1 3/2010 Matsuzaki
2012/0176868 A1 7/2012 Matsuzaki

FOREIGN PATENT DOCUMENTS

EP 1884753 A1 2/2008
EP 2161633 A2 3/2010
JP 2002-267734 9/2002
JP 2006-322812 11/2006
JP 2008-145287 6/2008
JP 2009-014668 1/2009
JP 2010-060456 3/2010
JP 2011-033381 2/2011
JP 2011-075380 4/2011

* cited by examiner

*Primary Examiner* — Amy Cohen Johnson
*Assistant Examiner* — Jason Collins

(57) ABSTRACT

An electronic timepiece efficiently acquires leap second information, reduces power consumption, and enables displaying the correct time. A GPS wristwatch 1 has a satellite signal reception unit 10A that receives satellite signals, a power supply including a solar panel 70 and storage battery 60, a time information adjustment unit 25 that keeps time, a reception timing determination unit 24 that operates the satellite signal reception unit 10A, receives a satellite signal, and acquires leap second information contained in the satellite signal, and a reception determination unit 23 that detects the remaining capacity of the storage battery 60. When the remaining battery capacity measured by the reception determination unit 23 is greater than or equal to a specific value, the reception timing determination unit 24 sets the reception frequency for receiving a satellite signal higher than when the remaining battery capacity is less than the specific value.

20 Claims, 9 Drawing Sheets

ELECTRONIC TIMEPIECE AND CONTROL METHOD THEREFOR

BACKGROUND

1. Technical Field

The present invention relates to an electronic timepiece and to a method of controlling an electronic timepiece that receives and acquires the current date and time from signals sent from GPS satellites or other positioning information satellites.

2. Related Art

GPS satellites with known orbits around the Earth are used in the GPS system, which can be used to determine one's position, and each GPS satellite carries an atomic clock. Each GPS satellite therefore also keeps extremely precise time information (also referred to as the GPS time or satellite time).

Because the satellite time does not account for leap seconds, however, UTC (Coordinated Universal Time) must be obtained by adding the accumulated leap seconds to the satellite time. Because the current leap second information is carried on page 18 of subframe 14 of the GPS satellite signal, the correct time can be set if this leap second information is also received.

Timekeeping devices having unit of using the time and leap second information contained in the navigation message received from such positioning information satellites to correct the leap second of the internal time kept by the timekeeping unit of the timekeeping device are known from the literature. See, for example, Japanese Unexamined Patent Appl. Pub. JP-A-2008-145287.

The timekeeping device described in JP-A-2008-145287 first acquires subframe and page identification information and time information from the navigation message sent from the GPS satellite. The time until leap second correction data is sent next is then calculated, and the receiving unit receives the navigation message at the time the leap second correction data can be received. The leap second value of the internal time data kept by the timekeeping unit is then corrected based on the leap second correction data contained in the received navigation message.

The timekeeping device taught in JP-A-2008-145287 also performs the reception operation when the reception operation is not needed and when signals cannot be received from the GPS satellites, however, and power consumption therefore rises. A problem that therefore results when the timekeeping device is a small portable device, such as a wristwatch, with small battery capacity is that the duration time is shortened.

SUMMARY

The present invention is directed to solving the problem of the related art, and an object of the invention is to provide an electronic timepiece and a control method therefor that can efficiently acquire leap second information, reduce power consumption, and display the correct time.

A first aspect of the invention is an electronic timepiece including: a reception unit that receives satellite signals transmitted from positioning information satellites; a power supply having a battery that supplies power; a timekeeping unit that keeps time; a remaining battery capacity measurement unit that measures the remaining battery capacity; and a leap second information acquisition unit that operates the reception unit and receives a satellite signal, acquires leap second information contained in the satellite signal, sets the reception frequency for receiving the satellite signal higher when the remaining battery capacity measured by the remaining battery capacity measurement unit is greater than or equal to a specific value than when the remaining battery capacity is less than the specific value.

This aspect of the invention lowers the frequency of reception when the remaining battery capacity is low and less than a specific value, and increases the reception frequency when the remaining battery capacity is greater than or equal to the specific value. For example, if the battery voltage is detected as the remaining battery capacity and the battery voltage is less than or equal to a specific value of 3.8 V, the reception frequency is set to once an hour or continuously, and if the battery voltage is less than 3.8 V, the reception frequency is set to once a day. If the battery voltage is even lower, such as less than 3.6 V, the reception frequency may be set to zero, for example, so that the reception process for acquiring the leap second information is not performed.

Because the leap second information acquisition unit lowers the frequency of reception when the remaining battery capacity is low, system shutdowns caused by a drop in the remaining battery capacity due to power consumption by the reception process can be prevented.

The leap second information acquisition unit can also increase the reception frequency when there is sufficient battery voltage and receive signals frequently. As a result, the leap second information can be acquired sooner.

The leap second value of a GPS satellite signal is normally updated by adding 23:59:60 (+1 second), or deleting 23:59:59 (−1 second), on June 30 or December 31.

Adjustment by adding or deleting a leap second is normally announced approximately a half year in advance, and the leap second information of the satellite signals transmitted after leap second adjustment is announced also contains, in addition to the current leap second information, information related to the leap second insertion date and the leap second after insertion.

If the leap second insertion date arrives without this leap second information being received, the correct time cannot be displayed.

When there is sufficient remaining battery capacity, however, the invention increases the frequency of reception to receive the leap second information frequently, can therefore soon acquire the leap second information, and can reliably insert the leap second on the leap second insertion date. Furthermore, because the reception frequency is set according to the remaining battery capacity, the reception frequency decreases when the remaining battery capacity decreases, the reception process can be stopped, and system shutdowns can be prevented.

In an electronic timepiece according to another aspect of the invention, an illuminance detection unit that detects illuminance incident to the electronic timepiece; wherein when the leap second information acquisition process executes at a reception frequency determined by the remaining battery capacity, the leap second information acquisition unit executes the acquisition process only when the illuminance detected by the illuminance detection unit is greater than or equal to a previously set illuminance threshold.

Illuminance differs greatly between artificial lights indoors and sunlight outdoors. As a result, the illuminance threshold is set so that when the electronic timepiece is indoors and outdoors can be differentiated.

As a result, if the light detected by the illuminance detection unit is greater than or equal to the illuminance threshold, the electronic timepiece can be determined to be outdoors, and if the leap second information is acquired only in this case, the probability of successfully acquiring the leap second information can be improved, unnecessary reception processes are not required, and power consumption can be reduced.

As a result, when the reception frequency is set according to the remaining battery capacity, and the reception process is actually executed at the set reception frequency, this aspect of the invention performs the reception operation only when the detected illuminance is greater than or equal to the illuminance threshold, and can therefore prevent system shutdowns and acquire leap second information efficiently.

Further preferably in an electronic timepiece according to another aspect of the invention, the leap second information acquisition unit increases the illuminance threshold as the remaining battery capacity decreases, and decreases the illuminance threshold as the remaining battery capacity increases.

When the remaining battery capacity is high, the illuminance threshold is set lower than when the remaining battery capacity is low. When the illuminance threshold is low, reception is performed not only when outdoors exposed to the sky, but also when the electronic timepiece is outdoors sheltered by the eave of a building or indoors near a window. When the remaining battery capacity is high, the reception process is performed even when the reception environment is not particularly good, and leap second information can therefore be acquired soon. In addition, when the reception environment is not good, power consumption can increase because a satellite signal could not be captured or a long time is required to capture the leap second information, but system shutdowns can be prevented because the remaining battery capacity is high.

However, because the illuminance threshold is set higher when the remaining battery capacity is low than when the remaining battery capacity is high, the reception process can be performed only when outdoors where the possibility of being able to receive the satellite signal is good. As a result, the time required for the reception process can be shortened, and power consumption can be reduced.

In an electronic timepiece according to another aspect of the invention, the power supply includes a power generating device and a storage battery that stores power generated by the power generating device; and the remaining battery capacity measurement unit measures the remaining capacity of the storage battery.

If the power supply is rendered by a generating device and a storage battery, the reception process can be started again and the reception frequency can be increased if the remaining battery capacity rises as a result of power generation after the remaining battery capacity drops below the threshold level.

If a solar panel is used as the generating device, the solar panel can be used both as a generator and an illuminance detection unit. More specifically, because the power output of the solar panel changes according to the incident illuminance, the amount of light incident to the solar panel can be detected by detecting the power output of the solar panel.

Therefore, because the generating device and the illuminance detection unit both use the solar panel, the number of parts can be reduced, the electronic timepiece can be easily rendered more compactly, and the cost can be reduced compared with a configuration that has a separate illuminance detection unit.

In an electronic timepiece according to another aspect of the invention, the leap second information acquisition unit executes the leap second information acquisition process when the date kept by the timekeeping unit enters the preset reception period, and after the leap second information is acquired in the reception period, does not perform the reception process for acquiring leap second information until the reception period ends.

The reception process is the period in which the leap second information may be announced, and if June 30 or December 31, which is likely the insertion date, is set as the end of the reception period, the reception process may be set to the preceding 3 month or 6 month period.

Because the leap second information acquisition period is performed when the reception period is entered in this aspect of the invention, the probability of being able to acquire the update information can be improved if the leap second information has been updated. Furthermore, because the process of acquiring the leap second information is not performed again in the same reception period once the leap second information has been received, the leap second information acquisition process does not execute unnecessarily, and power consumption can be reduced.

In an electronic timepiece according to another aspect of the invention, the leap second information acquisition unit executes the leap second information acquisition process when the date kept by the timekeeping unit enters the preset reception period, and when the remaining time of the reception period is less than or equal to a specific time, sets the illuminance threshold lower than before the remaining time became less than or equal to the specific time.

The remaining time of the reception period is the time left until the reception period ends. For example, if the reception period is 3 months, the remaining time one month after the reception period starts is 2 months.

When the remaining time becomes less than a preset time, such as less than 30 days, this aspect of the invention lower the illuminance threshold from the setting at the beginning of the reception period. As a result, if when the reception period starts illuminance is less than the illuminance threshold and the leap second information acquisition process does not execute, the illuminance threshold is changed to a lower value so that the leap second information acquisition process executes. As a result, the probability of acquiring the leap second information before the reception period ends can be improved.

In an electronic timepiece according to another aspect of the invention, the leap second information acquisition unit executes the leap second information acquisition process when the date kept by the timekeeping unit enters the preset reception period, and when the remaining time of the reception period is less than or equal to a specific time, sets the reception frequency higher than before the remaining time became less than or equal to the specific time.

When the remaining time is less than or equal to a preset time, such as 30 days or less, the frequency of reception set when the reception period starts is increased. More specifically, because the frequency of reception is the number of times the reception process executes within a specific time, the reception interval is shortened. As a result, a frequency of reception set to once a day at the beginning of the reception period can be changed to a shorter interval when the reception period is entered to execute the leap second information acquisition process at a frequency of once an hour, for example. The probability of being able to acquire the leap second information before the reception period ends can therefore be improved.

In an electronic timepiece according to another aspect of the invention, the leap second information acquisition unit stops reception when a satellite signal cannot be received within a specific timeout period after reception starts, and sets the timeout period shorter as the remaining battery capacity decreases, and longer as the remaining battery capacity increases.

In this aspect of the invention reception stops if the specific timeout period passes without being able to receive a satellite signal during the reception process for acquiring leap second information. As a result, the reception process can be prevented from continuing when satellite signals cannot be received, such as when the reception process is performed in an environment not suited to receiving satellite signals.

In addition, because the timeout period is set according to the remaining battery capacity, the time until reception stops can be increased when there is sufficient remaining battery capacity, and the probability of being able to receive a satellite signal can be improved.

In addition, because the timeout period is shortened when the remaining battery capacity is low, system shutdowns resulting from the reception process continuing for a long time can be prevented.

In an electronic timepiece according to another aspect of the invention, the leap second information acquisition unit executes the leap second acquisition process when the date kept by the timekeeping unit enters the preset reception period, and when the remaining time of the reception period becomes less than or equal to a specific time, sets the timeout period longer than before the remaining time became less than or equal to the specific time.

This aspect of the invention sets the timeout period that is set when the reception process starts to a longer time when the remaining time becomes less than a preset time such as one month. For example, when the timeout period is set to one minute at the beginning of the reception period, the timeout period is increased to 3 minutes when the remaining time becomes short. Reception therefore continues for a longer time, and the probability of being able to acquire the leap second information before the reception period ends can be improved.

Another aspect of the invention is a method of controlling an electronic timepiece including a reception unit that receives satellite signals transmitted from positioning information satellites, a power supply having a battery that supplies power, a timekeeping unit that keeps time, a leap second information acquisition unit that operates the reception unit and receives a satellite signal, acquires leap second information contained in the satellite signal, and a remaining battery capacity measurement unit that measures the remaining battery capacity, the control method including steps of: measuring the remaining battery capacity by the remaining battery capacity measurement unit; and setting the reception frequency for receiving the satellite signal by the leap second information acquisition unit higher when the measured remaining battery capacity is greater than or equal to a specific value than when the remaining battery capacity is less than the specific value.

This aspect of the invention has the same effect as the electronic timepiece described above.

Other objects and attainments together with a fuller understanding of the invention will become apparent and appreciated by referring to the following description and claims taken in conjunction with the accompanying drawings.

DESCRIPTION OF EMBODIMENTS

Embodiment 1

A preferred embodiment of the present invention is described below with reference to the accompanying figures.

Figure 1:
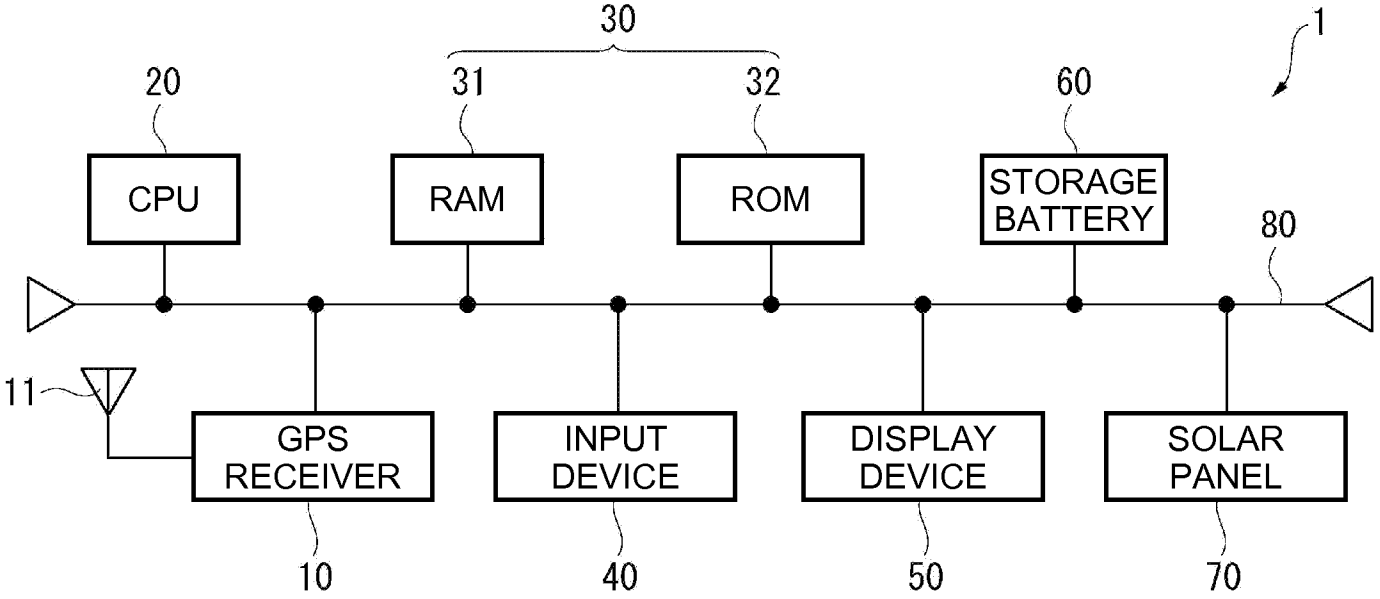
FIG. 1 is a block diagram showing the main circuit configuration of a GPS wristwatch as a preferred embodiment of an electronic timepiece according to the invention.

FIG. 1 schematically describes the main hardware configuration of a wristwatch with a GPS satellite signal receiver 1 (GPS wristwatch 1 below) as an example of an electronic timepiece according to the invention.

The GPS wristwatch 1 receives satellite signals and acquires satellite time information from a plurality of GPS satellites orbiting the Earth on known orbits, and uses the received information to correct internal time information and display the correct time.

Note that GPS satellites are one example of positioning information satellites as used herein, and plural satellites are currently in orbit. More specifically, approximately 30 GPS satellites are currently in orbit.

Buttons and a crown are also disposed to the GPS wristwatch 1 as external operating members.

Circuits of a GPS Wristwatch

The basic circuit configuration of the GPS wristwatch 1 is described next.

As shown in FIG. 1, the GPS wristwatch 1 includes a GPS receiver 10 (GPS module), control unit (CPU) 20, storage device (storage unit) 30, input device 40, display device 50, storage battery 60, and solar panel 70. The storage unit 30 includes RAM 31 and ROM 32. These devices exchange data with each other over a data bus 80.

The display device 50 is composed of hands (second hand, minute hand, and hour hand) and a display for displaying the time and positioning information.

The storage battery 60 is a battery that stores power produced by a solar panel 70 as a generating device, and the storage battery 60 and solar panel 70 render a power supply that supplies power to the GPS wristwatch 1.

Configuration of a GPS Receiver

The GPS receiver 10 includes a antenna 11, processes satellite signals received through the antenna 11, and acquires time information and positioning information therefrom.

The antenna 11 is, for example, a patch antenna that receives satellite signals from a plurality of GPS satellites on specific orbits around the Earth. This antenna 11 is located on the back cover side of the dial, and is configured to receive signals that pass through the crystal and the dial on the front of the GPS wristwatch 1.

As a result, the dial and the crystal are made of materials that easily pass RF signals such as the satellite signals transmitted from GPS satellites. For example, the dial is made of plastic.

Similarly to a common GPS receiver, and not shown in the figures, the GPS receiver of the GPS wristwatch 1 includes an RF (radio frequency) unit that receives and converts satellite signals sent from the GPS satellites to digital signals; a baseband unit that performs a correlation process to synchronize with the received signals; and an information acquisition unit that acquires time information and positioning information from the navigation message (satellite signal) demodulated by the baseband unit.

The RF unit includes a bandpass filter, PLL circuit, IF filter, VCO (voltage controlled oscillator), A/D converter, mixer, LNA (low noise amplifier), and IF amplifier.

Satellite signals extracted by the bandpass filter are amplified by the LNA and mixed with the VCO signal by the mixer, and then down-converted to an IF (intermediate frequency) signal. The IF signal mixed by the mixer passes through an IF amplifier and IF filter, and is converted to a digital signal by the A/D converter.

The baseband unit includes a local code generator and a correlation unit. The local code generator generates a local code that is identical to the C/A code used by the GPS satellite for signal transmission. The correlation unit calculates the correlation between this local code and the reception signal output from the RF unit.

If the correlation value calculated by the correlation unit is greater than a specific threshold value, the local code matches the C/A code used in the received satellite signal, and locking onto (synchronization with) the satellite signal is possible. As a result, the navigation message can be demodulated by applying a correlation process to the received satellite signal using the local code.

The data acquisition unit acquires the time information and positioning information from the navigation message demodulated by the baseband unit. More specifically, the navigation messages sent from the GPS satellites include preamble data and the TOW (Time of Week, also called the Z count) of the HOW (Handover Word), and subframe data. The subframe data includes subframes 1 to 5, and each subframe contains, for example, satellite correction data such as the week number and satellite health data, ephemeris (detailed orbit information for a particular GPS satellite), and almanac data (orbit information for all GPS satellites).

The data acquisition unit extracts specific data from the received navigation message, and acquires the time information and positioning information. A reception unit is therefore rendered by a GPS receiver 10 in this embodiment of the invention.

A program run by the control unit 20 is stored in ROM 32 in the storage unit 30.

The satellite signal acquired by the reception process, the time information and leap second information described below, and the location information calculated by a positioning calculation when signals are received in the positioning mode, are stored in RAM 31 in the storage unit 30.

Figure 2:
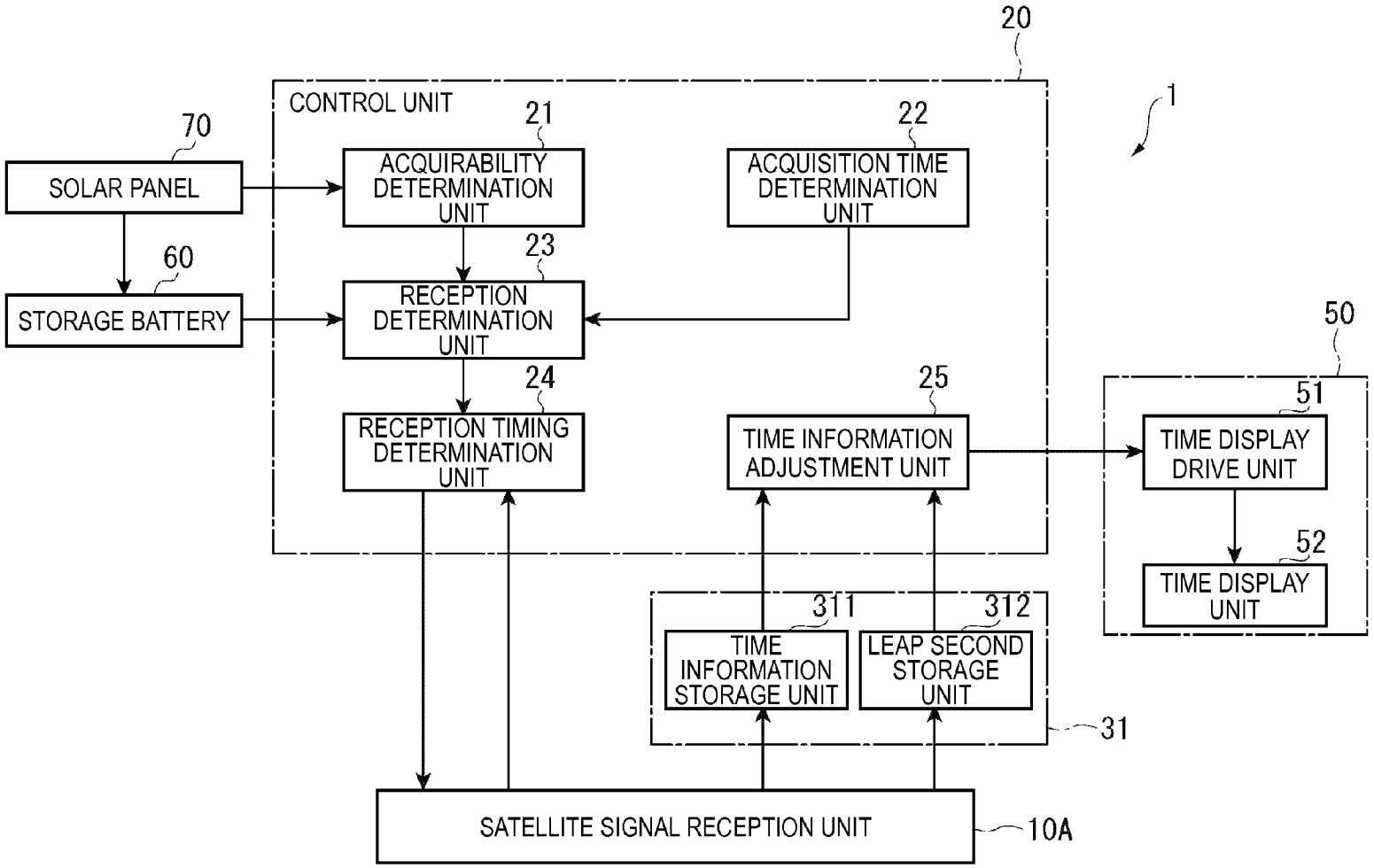
FIG. 2 is a block diagram showing the main system configuration of the GPS wristwatch shown in FIG. 1.

As shown in FIG. 2, therefore, RAM 31 includes a time information storage unit 311 that stores the time information acquired from received signals, and a leap second storage unit 312 that stores the acquired leap second information.

FIG. 2 is a block diagram showing the system configuration of the GPS wristwatch 1 according to this embodiment of the invention.

The control unit 20 (CPU) controls the satellite signal reception unit 10A of the GPS receiver 10, and corrects the local time information based on the acquired time information and leap second information.

The control unit 20 controls operation based on a program stored in ROM 32. The control unit 20 therefore includes an acquirability determination unit 21, acquisition time determination unit 22, reception determination unit 23, reception timing determination unit 24, and time information adjustment unit 25.

The acquirability determination unit 21 references the power output of the solar panel 70, and determines if the environment is suitable for satellite signal reception, that is, if a satellite signal can be acquired.

More specifically, when the power output (light exposure) of the solar panel 70 is greater than or equal to a specified illuminance threshold, the acquirability determination unit 21 determines that the GPS wristwatch 1 is outdoors and the environment is suited to satellite signal reception, that is, that a satellite signal can be received.

Figure 3:
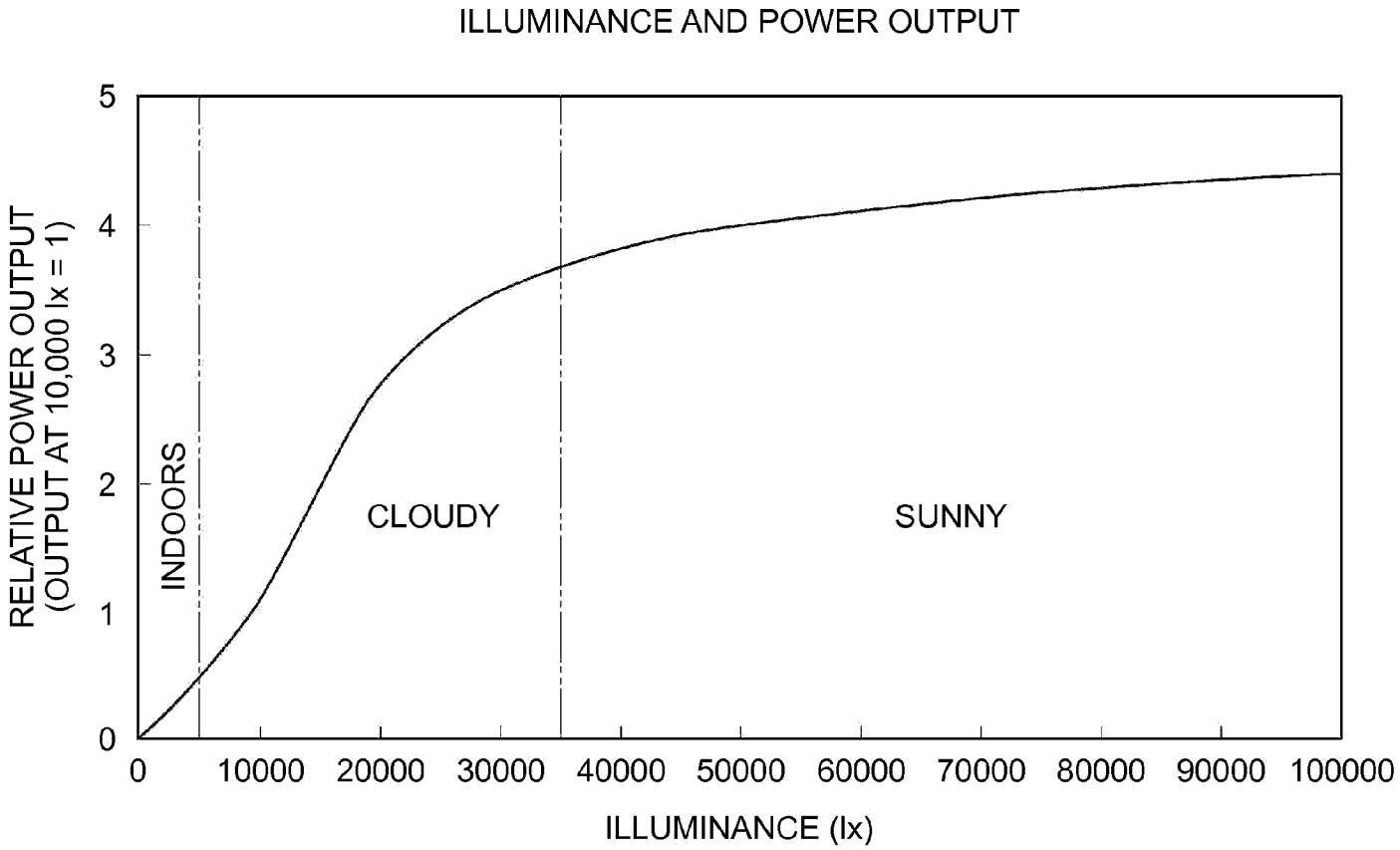
FIG. 3 is a graph showing an example of the relationship between illuminance and power output.

More specifically, the illuminance threshold is set based on the relationship between the illuminance of light incident to the solar panel 70 and the resulting power output. FIG. 3 is a graph showing the relationship between relative power output and illuminance when the power output at 10,000 lx (lux) is 1. As shown in FIG. 3, the power output of the solar panel 70 is greatest when outdoors on a sunny day, and power output is lower on a cloudy day than a sunny day. Power output is also lower when indoors than when outdoors on a cloudy day.

Because outdoors on both sunny and cloudy days is a better environment for generating power than indoors, the illuminance threshold is set to a level that enables differentiating power output when indoors (less than approximately 5000 lx) and outdoors (greater than approximately 5000 lx). In the example shown in FIG. 3, if the illuminance threshold is set to approximately 0.5 on the relative power output scale, whether the device is indoors or outdoors can be determined from the power output of the solar panel 70. If the GPS wristwatch 1 is outdoors, the environment can also be determined to be good for receiving GPS satellite signals.

However, if the power output of the solar panel 70 is less than the illuminance threshold, the acquirability determination unit 21 determines that the GPS wristwatch 1 is indoors and the environment is not suited to satellite signal acquisition.

The acquisition time determination unit 22 determines based on the internal clock when the time (reception period) for acquiring leap second information has come. More specifically, the acquisition time determination unit 22 determines if the current time is within a specific period before the day for updating the leap second. Because the first choice for inserting a leap second is June 30 or December 31 Japan time, the leap second information acquisition period is set in this embodiment of the invention to start 3 months before the first-choice dates of June 30 and December 31, and end on June 30 and December 31. The acquisition time determination unit 22 therefore determines the leap second acquisition (reception) period has been reached in Japan if the date is from April 1 to June 30 or October 1 to December 31.

The reception determination unit 23 detects the remaining capacity of the storage battery 60, which is charged by the power output of the solar panel 70. More specifically, the reception determination unit 23 detects the battery voltage of the storage battery 60, and a remaining battery capacity measurement unit is rendered by this reception determination unit 23.

The reception timing determination unit 24 sets the reception frequency according to the battery voltage detected by the reception determination unit 23, that is, according to the remaining battery capacity, and controls the satellite signal reception unit 10A to acquire the leap second information. A leap second information acquisition unit is thus rendered by the reception timing determination unit 24.

More specifically, when the detected voltage of the storage battery 60 is less than 3.6 V, the reception timing determination unit 24 sets the frequency of reception (leap second detection interval) to NONE because the remaining battery capacity is low, and the reception operation is not performed.

If the battery voltage is greater than or equal to 3.6 V and less 3.8 V, the reception timing determination unit 24 sets the reception frequency to once per day (leap second detection interval 2), and if the battery voltage is greater than or equal to 3.8V, sets the reception frequency to continuous, that is, so that the reception operation runs constantly (leap second detection interval 1).

The reception timing determination unit 24 thus controls the satellite signal reception unit 10A of the GPS receiver 10 and runs the reception process based on the output of the acquirability determination unit 21 and reception determination unit 23.

As further described below, the reception timing determination unit 24 also calculates the reception time of the leap second information, and operates the satellite signal reception unit 10A at the time suited to receiving the leap second information.

The satellite signal reception unit 10A runs the reception process and acquires the time information and leap second information. The satellite signal reception unit 10A also outputs the acquired information to the reception timing determination unit 24.

The time information and leap second information received by the satellite signal reception unit 10A is stored in the time information storage unit 311 and leap second storage unit 312 of the RAM 31.

The time information adjustment unit 25 controls the display device 50, which includes a time display drive unit 51 and time display unit 52. The time display unit 52 has hands, and the time display drive unit 51 is a motor or other unit of driving the hands.

Figure 4:
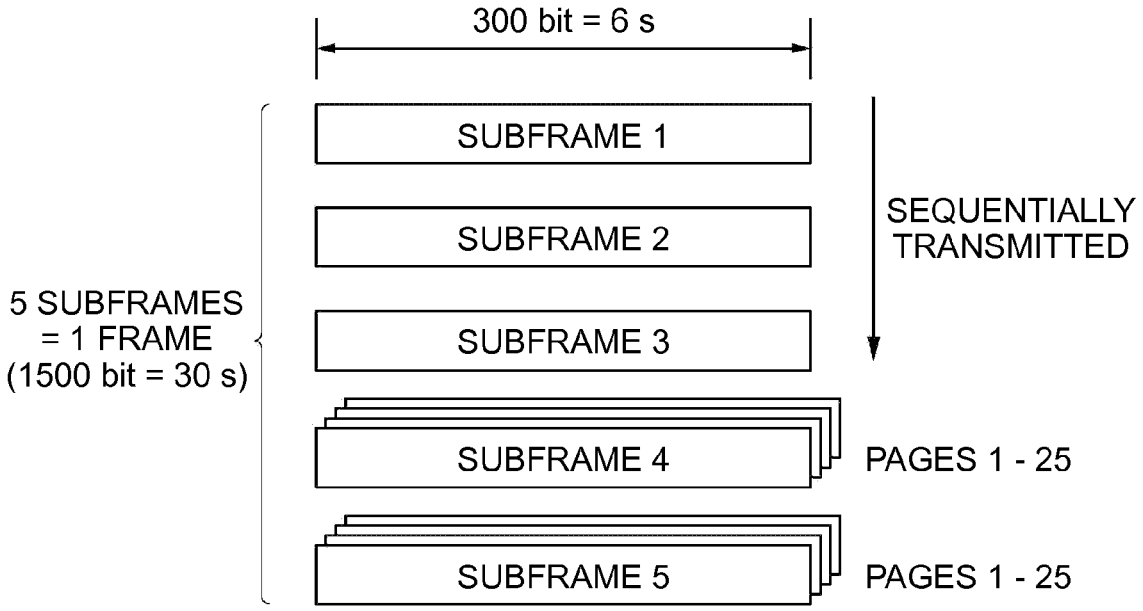
FIG. 4 describes the format of the navigation message.

The leap second reception timing of the reception timing determination unit 24 is described next. FIG. 4 shows the frame structure of a navigation message.

The satellite signals transmitted from the GPS satellites carry data called a navigation message. The navigation message contains orbit information and time information, and is transmitted at 50 bps.

One cycle of the navigation message is called a frame, and is structured as shown in FIG. 4. One frame contains 1500 bits, and therefore requires 30 seconds for transmission. One frame contains five subframes, each of which contains 300 bits. Each frame is sent sequentially starting from subframe 1, and when subframe 5 has been sent, transmission returns to the next subframe 1.

Because subframes 1 to 3 in each set of five subframes contain information specific to a particular satellite, the same content is repeated during every transmission. More specifically, subframes 1 to 3 contain clock correction data and orbit information (ephemeris) specific to the transmitting satellite. Subframes 4 and 5, however, contain orbit information for all satellites (almanac data) and ionospheric correction information, which are stored in subframes 4 and 5 over multiple pages because of the large amount of information.

More specifically, the data carried in subframes 4 and 5 is divided over pages 1 to 25, and different page content is sequentially transmitted in each frame. Because 25 frames are required to transmit the content of all pages, 12 minutes 30 seconds are required to receive all of the information in the navigation message.

Figure 5:
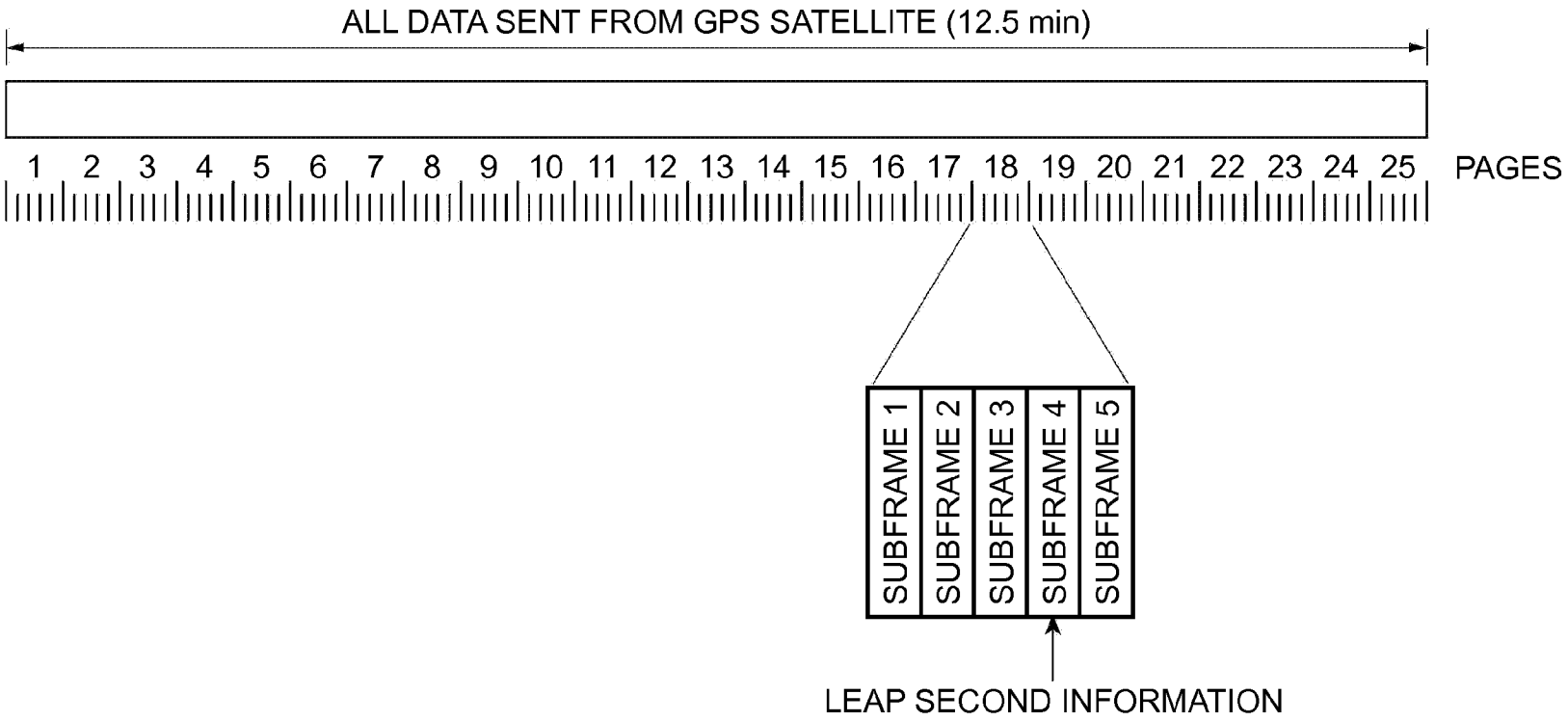
FIG. 5 shows the transmission timing of the leap second update information.

FIG. 5 shows the leap second transmission time. As shown in FIG. 5, the leap second information is contained in subframe 4 of page 18. More specifically, the current leap second is stored in $\textcircled{x}t_{LS}$, the leap second update week is stored in $WN_{LSF}$, the leap second update day is stored in DN, and the leap second after updating is stored in $\textcircled{x}t_{LSF}$ at bits 241 to 278 of subframe 4, page 18. Of these values, the leap second insertion week, the leap second insertion day, and the leap second after insertion are information essential to the next leap second insertion process, and constitute the leap second information as used herein. This leap second information is not stored as data until inserting a leap second is announced, but once insertion of a leap second is determined, the leap second information is broadcast and can be stored for approximately six months prior to the date the leap second is inserted. This leap second information can be acquired by receiving subframe 4 on page 18.

The navigation message of the satellite signal is transmitted referenced to 00:00:00 Sunday of every week. As a result, the time when subframe 4 of page 18 is transmitted (at a 12.5 minute interval) can be easily determined.

The time information (Z count), however, is transmitted in every subframe, and can therefore be received every 6 seconds. The week number is also transmitted in subframe 1, and can therefore be received every 30 seconds.

When the satellite signal reception unit 10A operates to acquire the time, the reception timing determination unit 24 executes the reception process timed to when the internal time matches the leap second transmission time, that is, when subframe 4 of page 18 is transmitted. Note that the internal time could also be offset from the time of the GPS satellite. In this case, reception timing determination unit 24 can determine the page and subframe of the signal being received, calculate the reception time, that is, the time until subframe 4 of page 18 containing the leap second information will be transmitted, and execute the reception process at that time.

The reception timing determination unit 24 receives the reception result from the satellite signal reception unit 10A, and if the leap second information was successfully received, controls operation so that the leap second information acquisition process does not execute again until the end of that reception period. For example, if the leap second information is successfully acquired on April 15 during the reception period from April 1 to June 30, the reception timing determination unit 24 does not execute the leap second information acquisition process again until the end of that reception period, that is, June 30. Because the leap second information is the same throughout the reception period, there is no need to receive the leap second information again once it has been received.

In addition, because the acquisition time determination unit 22 knows that the period starting July 1 in this case is not a leap second acquisition period, the leap second acquisition process does not execute until the next reception period (that is, October 1 to December 31 in this example).

Note that the process of receiving the normal time information (Z count) is still executed regularly, such as once a day.

The time information adjustment unit 25 corrects the time information stored in the time information storage unit 311, the current leap second stored in the leap second storage unit 312, and the time of the internal clock based on the time difference at the current location. This time difference information may be set by the user manually setting the time zone, for example, or set automatically by receiving the satellite signals and running the positioning process to acquire the current location, and then getting the time difference at the current location from a time zone table stored in RAM 31, for example.

After the leap second information has been acquired, the time information adjustment unit 25 updates the current leap second to the updated leap second value once the leap second insertion date and time arrives, and adjusts the time of the internal clock accordingly.

In addition, the time information adjustment unit 25 keeps the internal time based on a reference signal from an oscillation circuit not shown, for example, and continues updating the displayed time on the time display unit 52 by controlling the time display drive unit 51. The timekeeping unit of the invention is therefore also rendered by the time information adjustment unit 25.

Note that the time display drive unit 51 is a motor that drives the hands or a circuit that drives the display, for example.

Reception Process

The control process of the control unit 20 is described next with reference to the flow chart in FIG. 6. The process shown in FIG. 6 is a process in which the acquisition time determination unit 22 references the internal time, and receives leap second information after entering a leap second information acquisition (reception) period.

More specifically, when the acquisition time determination unit 22 determines that the internal time is within a leap second information acquisition period, it outputs a signal indicating that the time is within the leap second information acquisition period to the reception determination unit 23.

Figure 6:
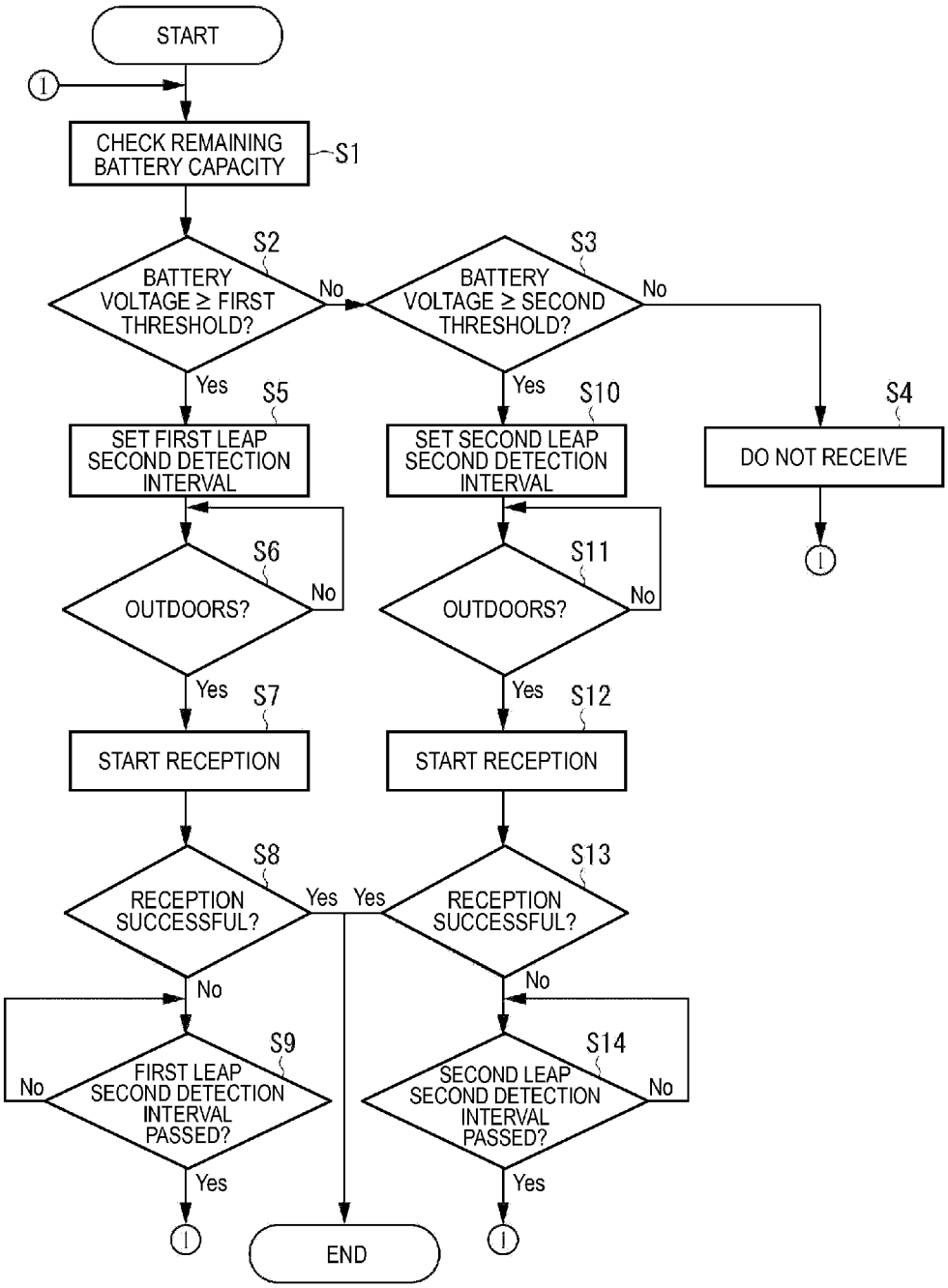
FIG. 6 is a flow chart of the reception process in a first embodiment of the invention.

This causes the reception determination unit 23 to start the leap second information acquisition process shown in the flowchart in FIG. 6.

The reception determination unit 23 first checks the remaining capacity of the storage battery 60 (S1). More specifically, the reception determination unit 23 detects the voltage of the storage battery 60. The reception determination unit 23 then determines if the storage battery 60 voltage is greater than or equal to a first threshold value (first specific value) (S2). The first threshold value is set to 3.8 V, and S2 returns Yes if the storage battery 60 voltage is greater than or equal to 3.8 V.

If S2 returns No, the reception determination unit 23 determines if the storage battery 60 voltage is greater than or equal to a second threshold value (second specific value) (S3). This second threshold value is set to 3.6 V, and if the storage battery 60 voltage is greater than or equal to 3.6 V and less than 3.8 V, S3 returns Yes.

The result of this battery voltage (remaining battery capacity) determination is output from the reception determination unit 23 to the reception timing determination unit 24.

If the battery voltage is less than 3.6 V

If S3 returns No, the storage battery 60 voltage is less than 3.6 V and the remaining battery capacity is low. When this result is received, the reception timing determination unit 24 sets the reception frequency to NONE and does not perform the reception process (S4). Control also returns to the remaining battery capacity detection step (S1), and the process continues.

If the battery voltage is greater than or equal to 3.8 V

If Yes is returned in S2, the reception timing determination unit 24 sets leap second detection interval 1 as the reception frequency (S5). In this embodiment of the invention leap second detection interval 1 causes the leap second detection process to run constantly, that is, leap second detection runs continuously.

The acquirability determination unit 21 then determines based on the power output of the solar panel 70 if the location is outdoors (S6).

As described above, the acquirability determination unit 21 in this embodiment of the invention determines if the GPS wristwatch 1 is in a location where GPS signals can be received, that is, is outdoors, by determining if the power output of the solar panel 70 is greater than or equal to an illuminance threshold.

If No is returned in S6, the acquirability determination unit 21 continues repeating S6 and does not start the reception process.

If Yes is returned in S6, the acquirability determination unit 21 outputs a signal indicating that the GPS wristwatch 1 is outdoors to the reception determination unit 23. As a result, the reception determination unit 23 outputs a signal to start reception to the reception timing determination unit 24, and the reception timing determination unit 24 drives the satellite signal reception unit 10A and starts reception (S7).

Note that the reception timing determination unit 24 controls operation of the satellite signal reception unit 10A according to the transmission timing of the leap second information based on the internal time in order to shorten the reception time as much as possible. Note, further, that if the internal time is incorrect, the satellite signal reception unit 10A will operate at a different time than the leap second information transmission time, but because the next leap second information transmission time can be detected from the time information (Z count) received at that time, the next reception process can be executed at the next leap second information transmission time.

The reception timing determination unit 24 then determines if receiving the leap second information was successful as a result of the reception process performed by the satellite signal reception unit 10A (S8).

If Yes is returned in S8, the reception timing determination unit 24 ends the leap second information reception process.

However, if No is returned in S8, the reception timing determination unit 24 determines if leap second detection interval 1 passed (S9). Because leap second detection interval 1 sets reception to run continuously, S9 immediately returns Yes. As a result, controls returns to the remaining battery capacity detection step in S1, and the process continues.

If the battery voltage is 3.6 to 3.8 V

If Yes is returned in S3, the reception timing determination unit 24 sets leap second detection interval 2 as the reception frequency. In this embodiment of the invention leap second detection interval 2 sets the leap second detection process to run once a day (S10).

The acquirability determination unit 21 then performs the same process as when the battery voltage is greater than or equal to 3.8 V. More specifically, the acquirability determination unit 21 determines if the location is outdoors based on the power output of the solar panel 70 (S11), and continues detecting the power output until S11 returns Yes.

When Yes is returned in S11, the reception timing determination unit 24 drives the satellite signal reception unit 10A and starts reception (S12).

The reception timing determination unit 24 then determines if receiving the leap second information was successful as a result of the reception process performed by the satellite signal reception unit 10A (S13).

If Yes is returned in S13, the reception timing determination unit 24 ends the leap second information reception process.

However, if No is returned in S13, the reception timing determination unit 24 determines if leap second detection interval 2 passed (S14). Because leap second detection interval 2 sets reception to run once a day, S14 returns Yes if a day has passed. As a result, controls returns to the remaining battery capacity detection step in S1, and the process continues.

As described above, the leap second information acquisition process is executed as shown in the flow chart in FIG. 6 until the leap second information is acquired.

Because the same information is transmitted until the leap second is updated, once the leap second information has been received in any leap second information acquisition period, there is no need to receive the leap second information again until the next leap second acquisition period. The leap second information acquisition process shown in FIG. 6 is therefore executed only once in any one leap second acquisition period.

When it is determined based on the leap second information that a leap second will be inserted, the leap second is processed when the leap second date arrives (normally June 30 or December 31). This enables the time display unit 52 to display the correct time.

Effect of this Embodiment

This embodiment of the invention can prevent system shutdowns and acquire leap second information early because the reception determination unit 23 detects the remaining battery capacity and the reception timing determination unit 24 sets the reception frequency for acquiring the leap second information according to the remaining battery capacity.

More specifically, when the remaining battery capacity is greater than or equal to 3.8 V, the reception process for acquiring the leap second information runs continuously and the leap second information can therefore be acquired soon. Furthermore, because the reception process executes while measuring the remaining battery capacity, system shutdown resulting from a sudden drop in the remaining battery capacity can be prevented.

Furthermore, because the leap second information detection interval is once a day when the remaining battery capacity is 3.6 to 3.8V, a drop in the remaining battery capacity can be suppressed and the duration time can be increased, and the leap second information can be acquired relatively soon. More particularly, because the leap second information acquisition period is set to approximately 3 months, the reception process runs approximately 30 times in one month if reception occurs once a day, and the probability of being able to acquire the leap second information is high. The leap second information can therefore be reliably acquired by the date when the leap second is scheduled to be updated, and the correct time can be set even if the leap second was updated.

In addition, when the remaining battery capacity is less than 3.6 V, sudden system shutdowns can be prevented because the leap second information update process is not performed. Because the leap second information can be acquired if the solar panel 70 is exposed to light and the remaining battery capacity increases, the probability of successfully receiving the leap second information in the leap second information acquisition period (reception period) can also be increased in this case.

Furthermore, because the acquirability determination unit 21 detects the power output of the solar panel 70 and the reception process runs only when the GPS wristwatch 1 can be expected to be outdoors, the reception process is not performed when the reception environment is poor, such as when the GPS wristwatch 1 is indoors. Satellite signals can therefore be received more efficiently when the reception process is performed. The possibility of successfully acquiring leap second information is therefore high, power consumption can be reduced, and battery life can be extended.

Furthermore, because the acquisition time determination unit 22 determines the leap second information acquisition period, the reception process can be executed only when acquiring the leap second information is necessary, leap second information can be efficiently acquired, needless reception processes can be reduced, and power consumption can be reduced.

In addition, because the reception timing determination unit 24 controls reception according to the timing of leap second information transmission, the leap second information can be reliably and efficiently acquired. More specifically, because receiving only subframe 4 of page 18 is enabled by using the reception timing determination unit 24, the reception time can be shortened to at most approximately 30 seconds, and power consumption can be reduced compared with a configuration that attempts reception without calculating the reception timing.

Furthermore, because after the leap second information has been acquired the reception timing determination unit 24 does not perform the leap second information acquisition process again until the leap second information acquisition period in which the leap second information was acquired ends, the reception process can be performed the minimum number of times required. This also enables reducing power consumption and extending the battery life.

Embodiment 2

A second embodiment of the invention is described next.

Figure 7:
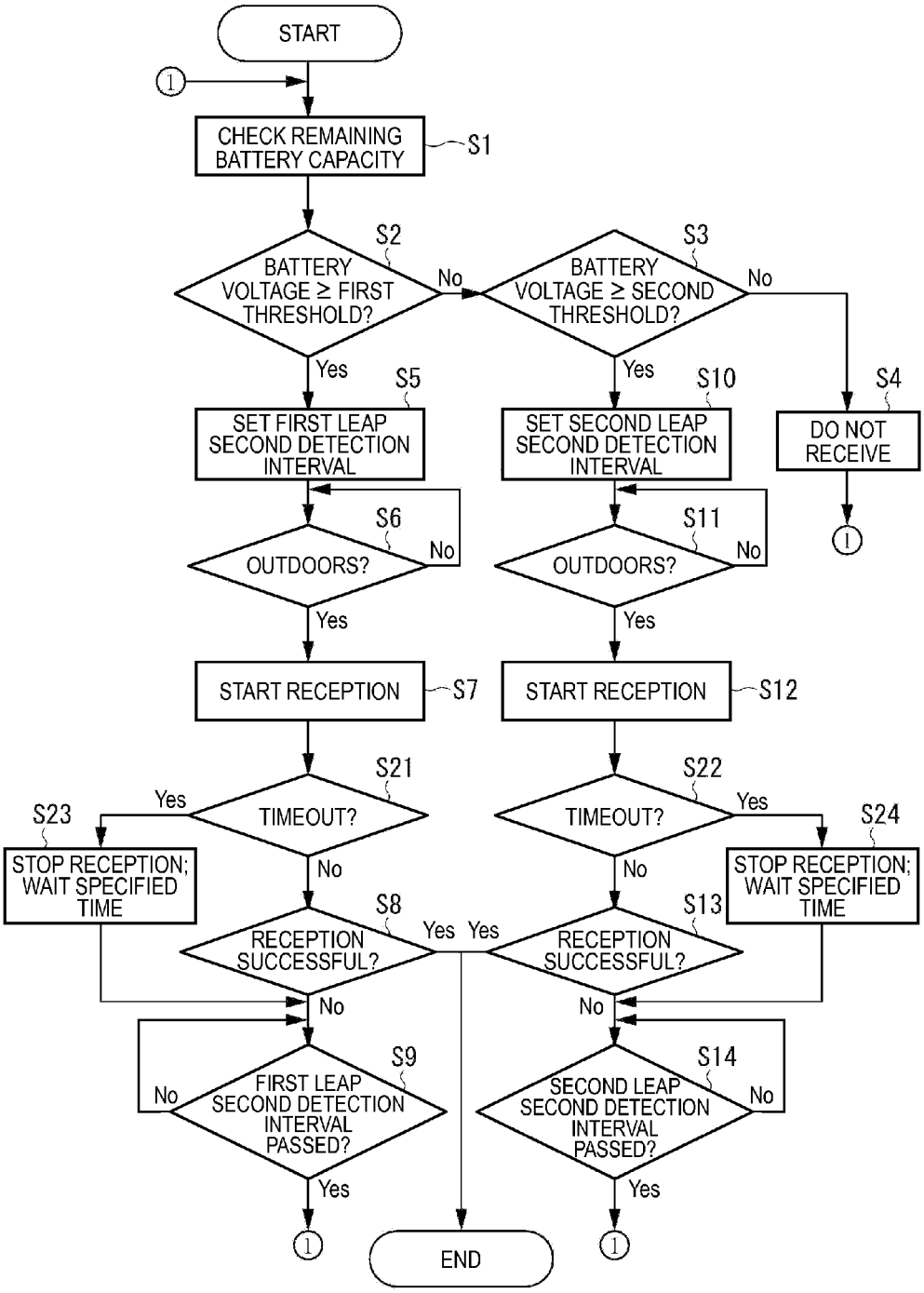
FIG. 7 is a flow chart of the reception process in a second embodiment of the invention.
Figure 8:
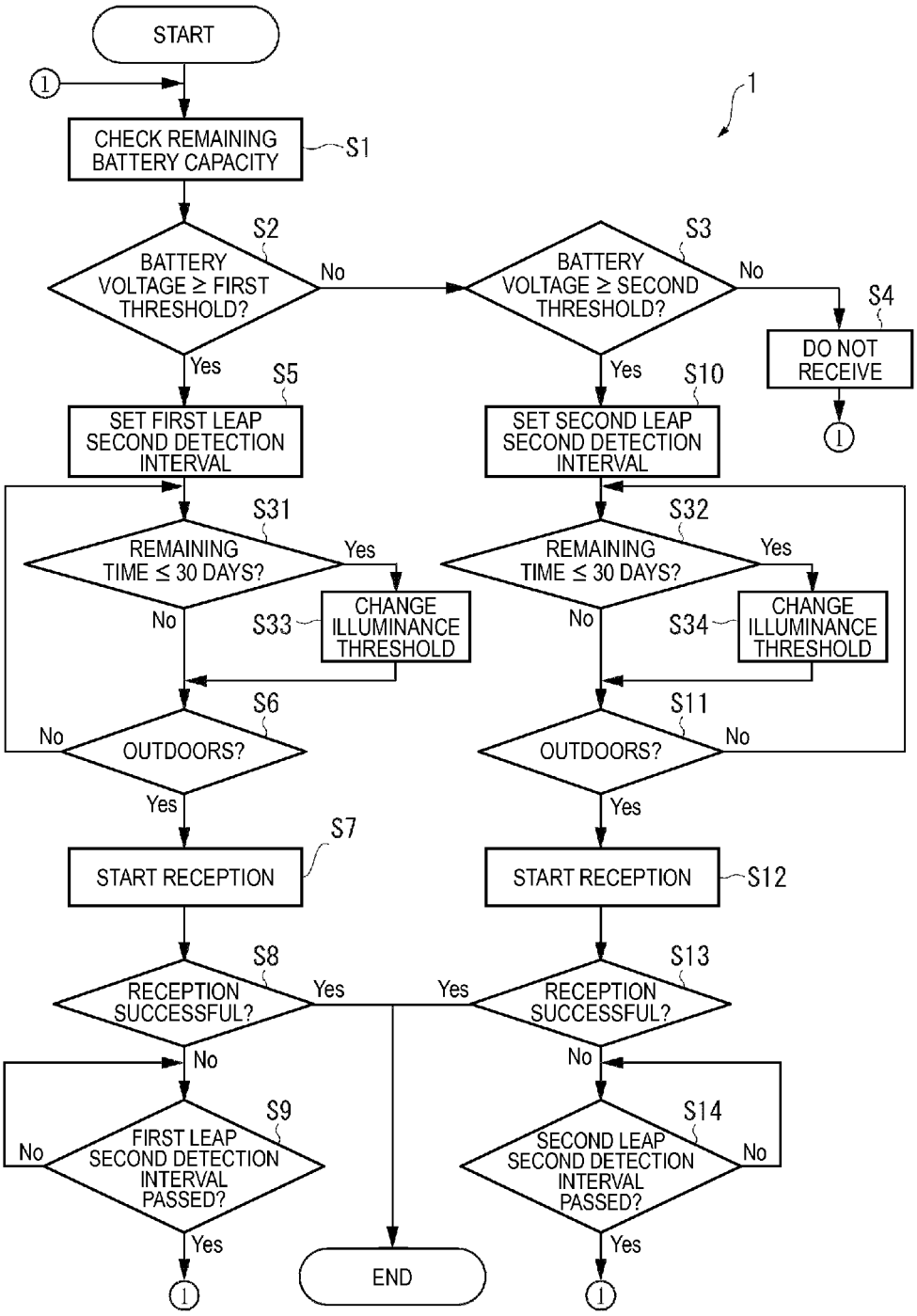
FIG. 8 is a flow chart of the reception process in a fourth embodiment of the invention.
Figure 9:
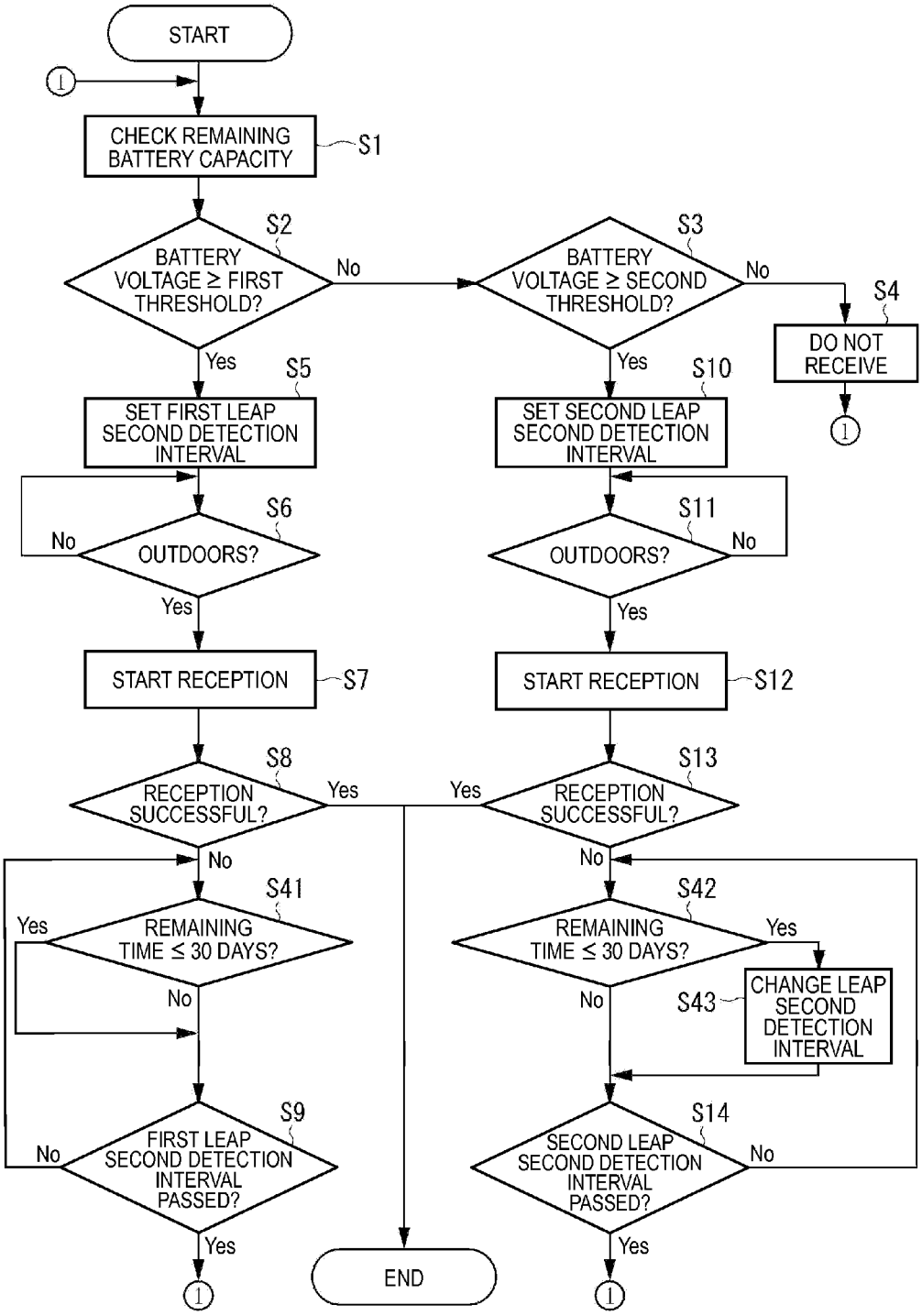
FIG. 9 is a flow chart of the reception process in a fifth embodiment of the invention.

As shown in the flow chart in FIG. 7, this second embodiment of the invention adds a timeout decision to the reception process.

Like steps in the process according to this second embodiment and the process of the first embodiment shown in the flow chart in FIG. 6 are therefore identified by like reference numerals and further description thereof is omitted below.

As in the first embodiment, when the leap second reception period comes in this second embodiment, the acquirability determination unit 21, acquisition time determination unit 22, reception determination unit 23, and reception timing determination unit 24 detect the remaining battery capacity (S1), compare the battery voltage and threshold value (S2, S3), set the leap second detection interval (S5, S10), determine if the GPS wristwatch 1 is outdoors (S6, S11), and start the reception process (S7, S12).

After starting the reception process in S7 or S12, the reception timing determination unit 24 determines if operation timed out without being able to receive a satellite signal (S21, S22).

More specifically, to receive a signal from a GPS satellite, the GPS receiver first performs a search process that looks for a satellite from which signals can be received. When this satellite search process is performed from a cold start in which the GPS wristwatch 1 has not yet acquired orbit information for all satellites (the almanac), the GPS receiver searches randomly for a GPS satellite. In this case, the search proceeds in order from GPS satellite 1 to GPS satellite 30, for example. In an environment where relatively strong satellite signals can be received, this search process can find a satellite in approximately 2 seconds.

Therefore, if a satellite signal cannot be received when the satellite search process (reception process) has run for a specific time, the GPS wristwatch 1 can be determined to be in an environment unsuitable for reception, such as indoors.

This embodiment of the invention determines if the environment is not suited to reception by performing this timeout detection step (S21, S22).

Note that the time used to determine that operation timed out is changed according to the battery voltage. That is, if Yes is returned in S2 and the reception process is performed in S7, the battery voltage is greater than or equal to 3.8 V and is high. As a result, the reception timing determination unit 24 sets a long timeout period such as 3 minutes.

However, if Yes is returned in S3 and the reception process is performed in S12, the battery voltage is 3.6 to 3.8 V. As a result, the reception timing determination unit 24 sets a shorter timeout period than in S21, such as 1 minute.

If No is returned by S21 or S22, that is, a satellite signal is received before operation times out, the process continues from S8 or S13 as in the first embodiment described above.

However, if Yes is returned by S21 or S22, a satellite signal could not be received within the timeout period, and the reception environment can be determined to not be good. In this case, the possibility is great that power will be wasted by continuing the reception process.

The reception timing determination unit 24 therefore stops the reception process and suspends processing for a specific time (S23, S24). In this case the reception process may be paused for 1 hour, for example. S9 or S14 then executes when the specific delay time has passed.

Because the leap second detection interval 1 is set to a frequency of continuous reception in S9, Yes is returned immediately and the process continues from S1.

However, because leap second detection interval 2 sets the reception frequency to once a day, S14 returns Yes if a day has passed since the start of the previous reception process, and returns to S1 and continues the process.

Effect of Embodiment 2

This second embodiment of the invention has the same effect as the first embodiment described above.

In addition, because an operation timeout is evaluated in S21 and S22, the reception process can be prevented from running needlessly when the reception environment is extremely poor and a GPS satellite signals cannot be received. A system shutdown resulting from the battery voltage dropping due to increased power consumption can therefore be prevented.

In addition, because the timeout period evaluated in S21 and S22 is set according to the battery voltage detected in S1, system shutdown can be prevented while the probability of successful satellite signal reception can be improved. More specifically, when the battery voltage is greater than or equal to 3.8 V, the timeout period in S21 is set to 3 minutes, and satellite signals can be received and the probability of successfully acquiring the leap second information can be improved when the environment is momentarily not suited to reception but conditions then change to enable reception. For example, when the user wearing the GPS wristwatch 1 is walking during the reception process and temporarily enters a shadow under the eave of a building where satellite signals cannot be received, satellite signals can be received again when the user walks out from under the eave, and the probability of successfully acquiring the leap second information can be improved.

On the other hand, because the timeout period in S22 is set to 1 minute when the battery voltage is 3.6 to 3.8 V, the reception process will not continue for more than one minute when satellite signals cannot be received, and wasteful power consumption can be prevented.

Embodiment 3

A third embodiment of the invention sets the illuminance threshold used by the acquirability determination unit 21 according to the measured battery voltage. The configuration of the GPS wristwatch 1 and the steps of the control process are therefore the same as in the first and second embodiments described above, and further description thereof is omitted.

In the first and second embodiments described above, the illuminance threshold used in S6 and S11 is the same (a voltage corresponding to 5000 lx).

In this third embodiment of the invention, however, the illuminance threshold used in S6 is set to a voltage corresponding to 3000 lx when the battery voltage is greater than or equal to 3.8 V, and when the battery voltage is 3.6 to 3.8 V, the illuminance threshold used in S11 is set to a voltage corresponding to 10,000 lx.

Effect of Embodiment 3

This third embodiment of the invention has the following effect in addition to the same effects as the embodiments described above.

That is, when the battery voltage is high (3.8 V or more), the illuminance threshold is low, and the reception process is therefore also performed when indoors. Even indoors, reception of signals from satellites at a low inclination angle may be possible through a window, for example. When the battery voltage is high, the possibility of a system shutdown is low even if a satellite signal cannot be received. The probability that the reception process will be performed is therefore increased by lowering the illuminance threshold, and the probability that leap second information can be acquired soon can be improved.

Because the illuminance threshold is high when the battery voltage is lower (3.6-3.8 V), the reception process is performed only when reliably in an outdoor location, and the probability of being able to receive a satellite signal can be improved.

Embodiment 4

This fourth embodiment of the invention sets the illuminance threshold used by the acquirability determination unit 21 according to how much time remains in the reception period. The configuration of this the GPS wristwatch 1 is therefore the same as in the first and second embodiments, and further description thereof is omitted.

The illuminance threshold in S6 and S11 is the same (a voltage corresponding to 5000 lx) during the reception period in the first embodiment.

In this fourth embodiment, the acquisition time determination unit 22 determines if the remaining reception period is less than or equal to than a specific period (S31, S32) before executing the outdoor determination step (S6, S11). More specifically, whether the remaining reception period (remaining number of days) is less than or equal to 30 days is determined.

If the remaining time is less than or equal to the specific time and S31 or S32 returns Yes, the acquirability determination unit 21 changes the illuminance threshold to a lower value (S33, S34).

For example, if the illuminance threshold when the reception period is entered is a voltage corresponding to 5000 lx, the illuminance threshold is changed in S33, S34 to a voltage equivalent to 3000 lx.

As in the third embodiment, the illuminance threshold can also be changed according to the length of the remaining reception period when the illuminance threshold is changed according to the battery voltage. For example, the illuminance threshold is set to a voltage corresponding to 3000 lx when the reception period is entered if the battery voltage is greater than or equal to 3.8 V, and is set to a voltage corresponding to 10,000 lx when the voltage is 3.6 to 3.8 V. In this case, when the remaining reception period is less than a specific time, the illuminance threshold is set to a voltage corresponding to 1000 lx when the battery voltage is greater than or equal to 3.8 V, for example, and is set to a voltage corresponding to 3000 lx when the battery voltage is 3.6 to 3.8 V.

Effect of Embodiment 4

This fourth embodiment of the invention has the following effect in addition to the same effects as the embodiments described above.

Because the illuminance threshold is lowered when the remaining length of the reception period is less than or equal to a specific time, the probability of Yes being returned in S6 and S11 increases, the number of times the leap second information reception process executes increases, and the probability that the leap second information can be acquired improves. The leap second information can therefore be received before the reception period ends, and the correct time can be reliably displayed even when the leap second update process was performed.

Embodiment 5

This fifth embodiment of the invention sets the leap second detection interval that is set by the reception timing determination unit 24 according the remaining length of the reception period. The configuration of the GPS wristwatch 1 is therefore the same as the foregoing embodiments, and further description thereof is omitted.

In the first embodiment of the invention the leap second detection interval evaluated in S9 and S14 is set based only on the battery voltage.

In this fifth embodiment, however, the reception timing determination unit 24 determines if the remaining length of the reception period is less than or equal to a specific time (S41, S42) before performing steps S9 and S14. More specifically, whether the remaining reception period (remaining number of days) is less than or equal to 30 days is determined.

If the remaining time is less than or equal to the specific time and S41 or S42 returns Yes, the reception timing determination unit 24 shortens the leap second detection interval. More specifically, the reception timing determination unit 24 increases the leap second information reception frequency.

Note that because leap second detection interval 1 results in continuous detection in this embodiment of the invention, the reception frequency cannot be further increased. As a result, the reception timing determination unit 24 only changes leap second detection interval 2 from a once a day detection interval (reception frequency) to, for example, once an hour or continuous detection identical to leap second detection interval 1 (S43).

Note that if leap second detection interval 1 is not continuous and is, for example, a frequency of once an hour, leap second detection interval 1 can also be changed to a shorter interval when Yes is returned in S41.

Effect of Embodiment 5

This fifth embodiment of the invention has the following effect in addition to the same effects as the embodiments described above.

When the remaining length of the reception period goes below the specific period, this aspect of the invention shortens the leap second detection interval, that is, increases the reception frequency, and can therefore improve the probability that the leap second information can be received because the number of times the leap second information is received also increases. The leap second information can therefore be received before the reception period ends, and the correct time can be reliably displayed even when the leap second update process was performed.

Other Variations

The invention is not limited to the foregoing embodiments and can be varied in many ways.

In the second embodiment above the timeout period is set based only on the battery voltage, but the timeout period could be increased when the length of the remaining reception period is less than or equal to a specific time. For example, the reception timing determination unit 24 could set the timeout period to 3 minutes if the battery voltage is greater than or equal to 3.8 V when the reception period is entered, to 1 minute if the battery voltage is 3.6 to 3.8 V, and if the remaining time is less than or equal to 30 days, to 5 minutes if the battery voltage is greater than or equal to 3.8V, and to 3 minutes if the battery voltage is 3.6 to 3.8 V.

Because the timeout period is increased if the length of the remaining reception period goes below this specific time, the number of opportunities for receiving the leap second information increases and the probability of being able to receive the leap second information can be improved. The leap second information can therefore be received before the reception period ends, and the correct time can be reliably displayed even when the leap second update process was performed.

The acquirability determination unit 21 is not limited to making a decision based on the power output of the solar panel 70 as described in the foregoing embodiments. For example, a photodiode, phototransistor, or other optical sensor could be used as the acquirability determination unit 21 to determine if the GPS wristwatch 1 is outdoors.

While an outdoor determination is made in S6 and S11 in the foregoing embodiments to eliminate wasteful reception processes, this decision step could be omitted. More specifically, the invention requires that the leap second detection interval be set based on the remaining battery capacity, and other evaluation conditions can be omitted.

However, the outdoor determination in S6 and S11 enable preventing wasteful reception processes, and therefore provides the advantage of being able to reduce power consumption.

The limited configurations described in the foregoing embodiments can also be applied to other embodiments. For example, the timeout evaluation step of the second embodiment could also be applied in the third to fifth embodiments.

Changing the timeout period, changing the leap second detection interval, and changing the illuminance threshold based on the remaining time in the reception period could also be used in combination. More specifically, changes in plural conditions could be combined so that, for example, the illuminance threshold is lowered if the remaining reception period is less than or equal to 30 days, the leap second detection interval is also shortened (increasing the reception frequency) if the remaining reception period is less than or equal to 20 days, and the timeout period is also increased if the remaining reception period is less than or equal to 10 days.

The electronic timepiece according to the invention is not limited to analog timepieces having hands, and can also be applied to hybrid timepieces having both analog hands and a digital display, and to digital timepieces having only a digital display. The invention is also not limited to wristwatches, and can be adapted to table clocks, pocket watches, and other types of timepieces, cellular telephones, digital cameras, personal navigation devices, and other types of information terminals having a timekeeping function.

The power generating device of the foregoing embodiments is also not limited to a solar panel 70, and could be a device that drives a generator using a rotary pendulum, but a solar panel 70 has the advantage of also being useful for an indoor/outdoor determination.

Further alternatively, the storage battery 60 could be charged from an external power supply, such as a wall outlet, instead of providing the GPS wristwatch 1 with a power generating device.

The power supply is also not limited to a rechargeable storage battery, and a primary battery could be used instead.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2011-068872, filed Mar. 25, 2011 is expressly incorporated by reference herein.

What is claimed is:

1. An electronic timepiece comprising:

a reception unit that receives satellite signals transmitted from positioning information satellites, said satellite signals including leap second information;

a power supply having a battery that supplies power;

a timekeeping unit that keeps time;

a remaining battery capacity measurement unit that measures the remaining battery capacity; and a leap second information acquisition unit that:

identifies reception period during which leap second information may be received;

divides said reception periods into a plurality of leap second determination intervals of equal time-length;

selectively executes a leap second determination process that operates the reception unit to receive leap second information contained in a satellite signal; and at the beginning of each reception period, assigns a maximum-execution number to the current leap second determination interval dependent upon the current remaining battery capacity, the leap second determination process being limited to executing no more than the maximum-execution number of times during the current leap second determination interval;

wherein in response to the execution of a leap second determination process successfully receiving leap second information within any of said leap second determination intervals, no further executions of the leap second determination process are permitted for the remaining of the current reception period.

2. The electronic timepiece described in claim 1, further comprising:

an illuminance detection unit that detects illuminance incident to the electronic timepiece;

wherein the leap second information acquisition unit attempts to receive leap second information only when the illuminance detected by the illuminance detection unit is greater than or equal to a previously set illuminance threshold.

3. The electronic timepiece described in claim 2, wherein:

the leap second information acquisition unit increases the illuminance threshold as the remaining battery capacity decreases, and decreases the illuminance threshold as the remaining battery capacity increases.

4. The electronic timepiece described in claim 2, wherein when the timepiece is within a current one of said reception periods and the remaining time of the current reception period is less than or equal to a specific time, the illuminance threshold is set lower than before the remaining time of the current reception period became less than or equal to the specific time.

5. The electronic timepiece described in claim 1, wherein:

the power supply includes a power generating device and a storage battery that stores power generated by the power generating device; and the remaining battery capacity measurement unit measures the remaining capacity of the storage battery.

6. The electronic timepiece described in claim 1, wherein:

each of said reception periods spans multiple days;

each of said plurality of leap second determination intervals is one day long;

the time kept by the timekeeping unit includes date information;

the leap second information acquisition unit uses date information to determine when the timepiece is within a reception period.

7. The electronic timepiece described in claim 1, wherein when the timepiece is within a current one of said reception periods and the remaining time of the current reception period is less than or equal to a specific time, the maximum-execution number is set higher than before the remaining time of the current reception period became less than or equal to the specific time.

8. The electronic timepiece described in claim 1, wherein:

the leap second information acquisition unit stops reception when a satellite signal cannot be received within a specific timeout period after reception starts, and sets the timeout period shorter as the remaining battery capacity decreases, and longer as the remaining battery capacity increases.

9. The electronic timepiece described in claim 8, wherein when the timepiece is within a current one of said reception periods and the remaining time of the preset reception period becomes less than or equal to a specific time, the timeout period is set longer than before the remaining time preset reception period became less than or equal to the specific time.

10. The electronic timepiece described in claim 1, wherein within each of said leap second determination interval, the time when reception of the leap second information is attempted is indeterminate.

11. The electronic timepiece described in claim 10, wherein within each of said leap second determination interval, the time when reception of the leap second information is attempted is based on environmental factors.

12. The electronic timepiece described in claim 10, wherein within a current leap second determination interval, the leap second information acquisition unit executes the leap second determination process fewer times than the maximum-execution number set for the current leap second determination interval if environmental factors preclude its execution.

13. The electronic timepiece described in claim 1, wherein at the end of the current leap second determination interval, the leap second information acquisition unit assigns a new maximum-execution number to the next leap second determination interval dependent upon the current remaining battery capacity.

14. The electronic timepiece described in claim 1, wherein the maximum-execution number increases with increasing remaining battery capacity.

15. The electronic timepiece described in claim 1, wherein the lowest permissible value for the maximum-execution number indicates the prohibition of any leap second determination process and the highest permissible value for the maximum-execution number indicates continuous execution of the leap second determination process.

16. The electronic timepiece of described in claim 15, wherein a maximum-execution number between the lowest permissible value for the maximum-execution number and highest permissible value for the maximum-execution number is a discrete number higher than zero indicating a discrete number of permissible executions of the leap second determination process.

17. The electronic timepiece described in claim 1, wherein:

the satellite signals further include current time information; and the reception unit is operated to receive satellite signals regularly at least once during each leap second determination interval to receive current time information irrespective of the remaining battery level any assigned maximum-execution number.

18. The electronic timepiece of claim 17, wherein each reception period lasts multiple months, and each reception period is at least one day long.

19. The electronic timepiece described in claim 1, wherein the leap second information included in satellite signals transmissions is constant within each identified reception period.

20. A method of controlling an electronic timepiece including a reception unit that receives satellite signals transmitted from positioning information satellites, said satellite signals including leap second information, a power supply having a battery that supplies power, a timekeeping unit that keeps time, a leap second information acquisition unit that identifies reception periods during which leap second information may be received, divides said reception periods into a plurality of leap second determination intervals of equal time-length, and selectively executes a leap second determination process that operates the reception unit and to receive leap second information included in a satellite signal, and a remaining battery capacity measurement unit that measures the remaining battery capacity, the control method comprising steps of:

at the beginning of each reception period, measuring the current remaining battery capacity by using the remaining battery capacity measurement unit; and assigning a maximum-execution number to the current leap second determination interval dependent upon the measured current remaining battery capacity;

wherein:

the leap second determination process is limited to executing no more than the maximum-execution number of times during the current leap second determination interval;

in response to the execution of a leap second determination process successfully receiving leap second information within any of said leap second determination intervals, no further executions of the leap second determination process are permitted for the remainder of the current leap second determination interval and current reception period and current irrespective of the maximum-execution number and remaining battery capacity.

* * * * *